US009677800B2

(12) United States Patent
Kim et al.

(10) Patent No.: US 9,677,800 B2
(45) Date of Patent: Jun. 13, 2017

(54) REFRIGERATOR WITH AN ICE TRANSFER FLOW DUCT

(71) Applicant: LG Electronics Inc., Seoul (KR)

(72) Inventors: Dongjeong Kim, Seoul (KR); Donghoon Lee, Seoul (KR); Wookyong Lee, Seoul (KR); Juhyun Son, Seoul (KR); Donghoon Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 498 days.

(21) Appl. No.: 13/895,436

(22) Filed: May 16, 2013

(65) Prior Publication Data

US 2013/0305771 A1 Nov. 21, 2013

(30) Foreign Application Priority Data

May 16, 2012 (KR) ..... 10-2012-0052112

(51) Int. Cl.
*F25C 5/18* (2006.01)
*F25C 1/00* (2006.01)
(Continued)

(52) U.S. Cl.
CPC ..... *F25C 1/00* (2013.01); *F25C 5/005* (2013.01); *F25D 23/068* (2013.01); *F25C 5/002* (2013.01);
(Continued)

(58) Field of Classification Search
CPC ..... F25C 2400/06; F25C 5/007; F25C 5/005; F25C 5/002; F25C 1/00; F25D 2317/0654;
(Continued)

(56) References Cited

U.S. PATENT DOCUMENTS 4,614,141 A * 9/1986 Mendenhall ..... B26D 7/01 83/402
6,314,745 B1 * 11/2001 Janke ..... F25C 5/005 62/137
(Continued)

FOREIGN PATENT DOCUMENTS

CN 101523137 9/2009
JP 2007-101157 A 4/2007
(Continued)

OTHER PUBLICATIONS

Translation of Korean Patent Document KR 20110037609A named KR 20110037609A-Translation, translated Sep. 2015.*
(Continued)

*Primary Examiner* — Justin Jonaitis
*Assistant Examiner* — Paul Alvare
(74) *Attorney, Agent, or Firm* — Fish & Richardson P.C.

(57) ABSTRACT

A refrigerator includes an ice bank installed on a refrigerating compartment door, a dispenser provided below the ice bank, and an ice maker provided in a freezing compartment. The refrigerator also includes a transfer element connected to a side of the ice maker and configured to transfer ice made by the ice maker to the ice bank. The refrigerator further includes a first duct connecting an outlet of the transfer element and the ice bank and a second duct connecting the ice bank and the freezing compartment. One of the first duct and the second duct is a cold air supplying duct that supplies cold air to the ice bank and another of the first duct and the second duct is a cold air return duct that returns cold air of the ice bank to the freezing compartment.

11 Claims, 11 Drawing Sheets

(51) Int. Cl.
*F25D 23/06* (2006.01)
*F25C 5/00* (2006.01)

(52) U.S. Cl.
CPC ..... *F25C 5/007* (2013.01); *F25C 2400/06* (2013.01); *F25D 2317/067* (2013.01); *F25D 2317/0654* (2013.01); *F25D 2317/0664* (2013.01); *F25D 2317/0666* (2013.01)

(58) Field of Classification Search
CPC ..... F25D 2317/0664; F25D 2317/0666; F25D 2317/067; F25D 23/068
USPC ..... 62/344
See application file for complete search history.

(56) References Cited

U.S. PATENT DOCUMENTS 6,490,870 B1 * 12/2002 Efremkine ..... B67D 1/0869 62/3.64
2006/0086127 A1 * 4/2006 Anselmino ..... F25C 5/005 62/340
2006/0086130 A1 4/2006 Anselmino
2008/0134710 A1 * 6/2008 An ..... F25C 5/007 62/344
2008/0156024 A1 * 7/2008 Shin ..... F25C 5/182 62/344
2009/0314024 A1 12/2009 Choi
2012/0023999 A1 2/2012 Oh
2012/0024001 A1 2/2012 Oh
2012/0024002 A1 * 2/2012 Oh ..... F25C 5/005 62/344

FOREIGN PATENT DOCUMENTS

KR 10-2011-0037609 A 4/2011
KR 20110037609 A * 4/2011

OTHER PUBLICATIONS

European Search Report dated Nov. 13, 2013 for Application No. 13167815.3-1605, 3 pages.

* cited by examiner

REFRIGERATOR WITH AN ICE TRANSFER FLOW DUCT

CROSS-REFERENCE TO RELATED APPLICATIONS

The present application claims priority under 35 U.S.C. 119 and 35 U.S.C. 365 to Korean Patent Application No. 10-2012-0052112 (filed on May 16, 2012), which is hereby incorporated by reference in its entirety.

FIELD

This disclosure relates to a refrigerator.

BACKGROUND

Generally, refrigerators are home appliances configured to contain food and drinks at lower temperatures inside storage spaces shielded by doors. A refrigerator is configured to keep stored foods and drinks fresher by cooling the inside of a storage space by using cold air generated through heat exchange with a refrigerant circulating a refrigeration cycle.

Also, generally, inside the refrigerator, an ice maker for making ice is provided. The ice maker is configured to make ice by using water supplied from a water source or a water tank to an ice tray. Also, the door of the refrigerator may include a dispenser allowing water or ice made by the ice maker to be discharged outwards.

SUMMARY

In one aspect, a refrigerator includes a cabinet, a refrigerating compartment located in the cabinet, and a freezing compartment located in the cabinet. The refrigerator also includes a refrigerating compartment door configured to open and close at least a portion of the refrigerating compartment, an ice bank installed on the refrigerating compartment door and configured to store ice therein, and a dispenser provided below the ice bank and configured to discharge ice stored in the ice bank through the refrigerating compartment door. The refrigerator further includes an ice maker provided in the freezing compartment and configured to make ice, a transfer element connected to a side of the ice maker and configured to transfer ice made by the ice maker to the ice bank, a first duct connecting an outlet of the transfer element to the ice bank and defining a path for transferring ice from the transfer element to the ice bank, and a second duct configured to enable exchange of air between the ice bank and the freezing compartment. One of the first duct and the second duct is a cold air supply duct configured to supply cold air from the freezing compartment to the ice bank and another of the first duct and the second duct is a cold air return duct configured to return cold air of the ice bank to the freezing compartment.

Implementations may include one or more of the following features. For example, a cross section of the first duct may be a polygon. A cross section of the first duct may be a tetragon. At least a part of a cross section of the first duct may be rounded with a certain curvature.

In some implementations, the first duct may include an auxiliary duct located on a side part of the first duct such that the first duct and the auxiliary duct are a single body. In these implementations, the auxiliary duct may be the portion of the first duct through which cold air flows. Further, in these implementations, the refrigerator may include a connecting duct that connects the auxiliary duct to the first duct.

In some examples, the refrigerator may include at least one rib that protrudes from an inner wall of the first duct and extends along the first duct. In these examples, the rib may have a radial shape and may be configured to guide ice being transferred from the transfer element to the ice bank in a center of the first duct. Also, in these examples, the first duct may be configured to guide cold air between the ice being transferred and an inner wall of the first duct.

Further, the rib may be located on a first inner side of the first duct and may be configured to guide ice being transferred from the transfer element to the ice bank along a second inner side of the first duct. The rib may be configured to guide cold air along a peripheral space of the rib.

In some implementations, the refrigerator may include a fan provided on a side of the first duct and configured to promote cold air circulation between the ice bank and the freezing compartment. In these implementations, the fan may be configured to supply cold air from the freezing compartment to the ice bank or return cold air from the ice bank to the freezing compartment according to a direction of rotation thereof.

In some examples, the ice maker may be configured to make spherical pieces of ice. In these examples, the ice maker may include an upper tray comprising a first depression and a lower tray comprising a second depression. The upper tray and the lower tray may be arranged such that the first depression extends away from the lower tray and the second depression extends away from the upper tray. Further, in these examples, the first depression and the second depression each may have a hemisphere shape.

In another aspect, a refrigerator includes a cabinet with one side being opened, a freezing compartment located in the cabinet, a door configured to selectively shield an opened part of the cabinet, and an ice bank provided on a rear surface of the door and configured to store ice. The refrigerator also includes an ice maker provided inside the cabinet and configured to make ice, a housing configured to house ice made by the ice maker, and a transfer element provided inside the housing and configured to transfer ice from the housing. The refrigerator further includes a first duct connected to the housing and configured to guide ice transferred by the transfer element to the ice bank, a second duct connecting the ice bank to the freezing compartment, and a fan provided on a side of one of the first duct and the second duct and configured to promote circulation of cold air between the freezing compartment and the ice bank.

Implementations may include one or more of the following features. For example, the ice maker may be configured to make a certain shape of ice. In this example, a cross section of the first duct may be different from a cross section of ice made by the ice maker. Further, in this example, the ice maker may be configured to make spherical pieces of ice and the cross section of the first duct may be a polygon.

In addition, the refrigerator may include an auxiliary duct connecting the ice bank and the freezing compartment. The auxiliary duct may be connected to the first duct. The refrigerator also may include at least one rib that protrudes from an inner circumferential surface of the first duct and extends along a longitudinal direction of the first duct.

The details of one or more implementations are set forth in the accompanying drawings and the description, below. Other potential features of the disclosure will be apparent from the description and drawings, and from the claims.

DETAILED DESCRIPTION

Figure 1:
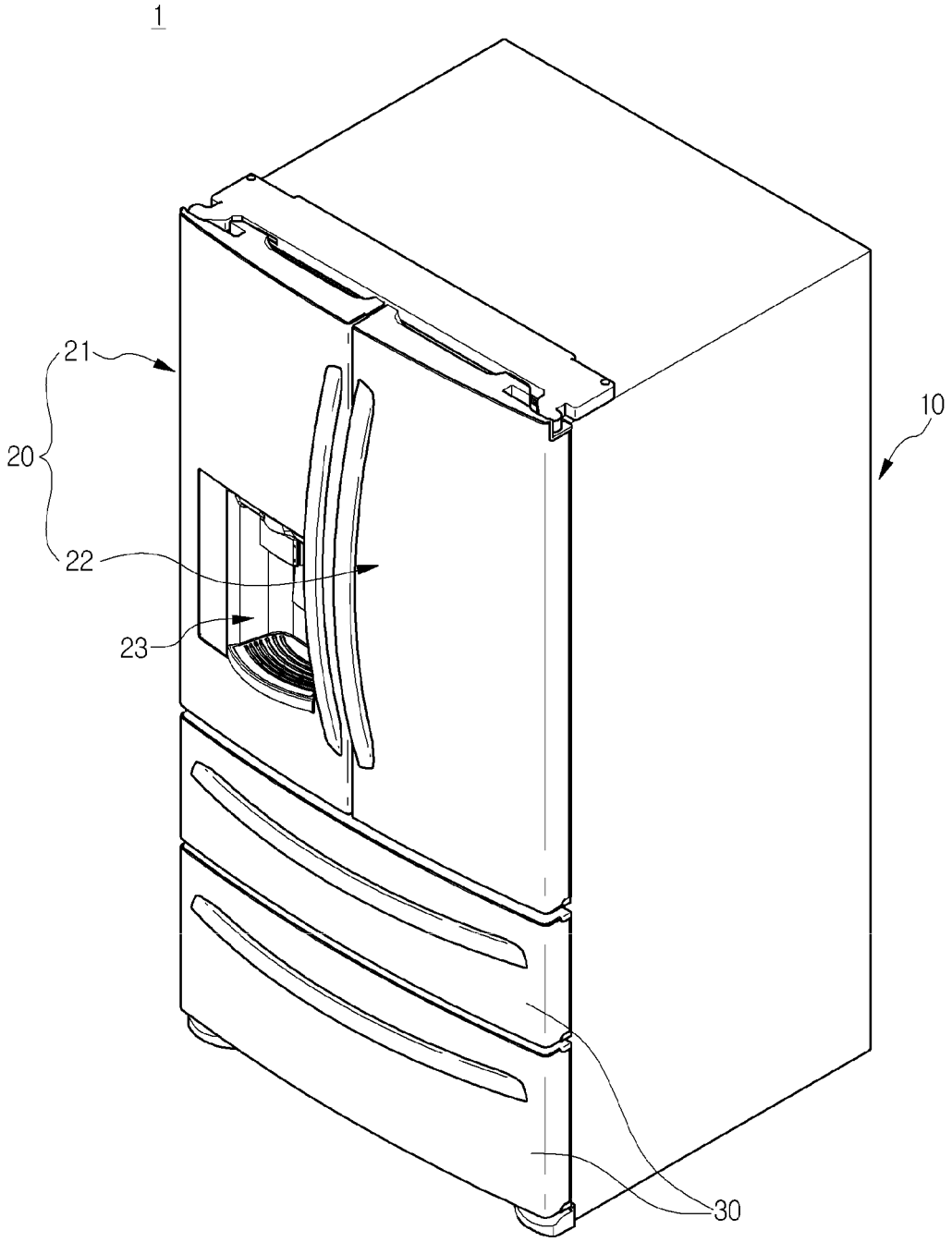
FIG. 1 is a perspective view illustrating an example refrigerator.

FIG. 1 illustrates an example refrigerator 1. Also, FIG. 2 illustrates example cold air circulation in an inner space of the refrigerator 1 and an example ice-making chamber of the refrigerator 1.

Figure 2:
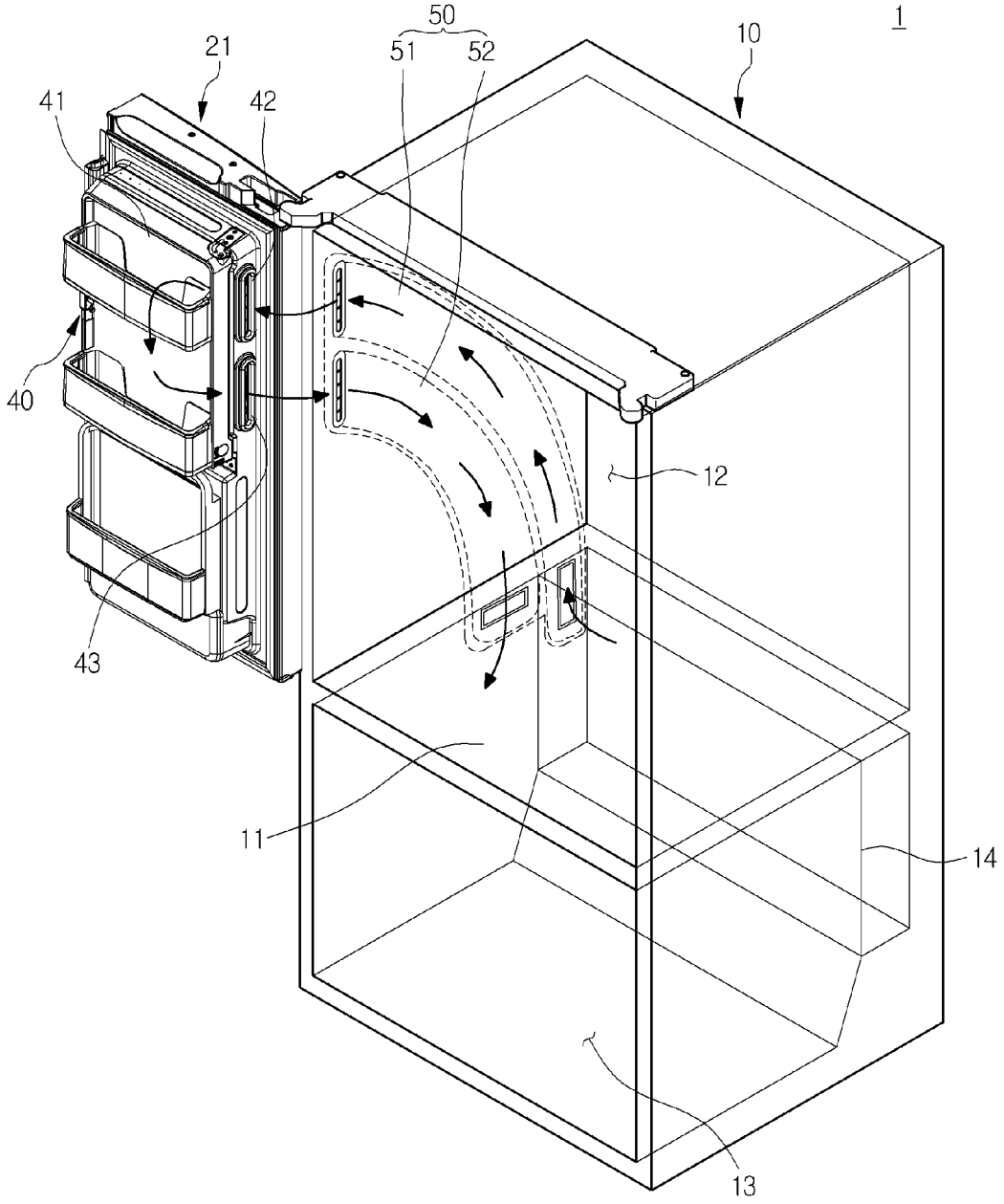
FIG. 2 is a perspective view illustrating example cold air circulation in an inner space and an example ice-making chamber of the refrigerator of FIG. 1.

Referring to FIGS. 1 and 2, the refrigerator 1 has an external shape defined by a cabinet 10 that has a storage space therein and doors 20 and 30 mounted on the cabinet 10 to be opened and closed.

The storage space inside the cabinet is divided by a barrier 11 into a top and a bottom. A refrigerating compartment 12 is located in the top, and a freezing compartment 13 is located in the bottom.

The doors 20 and 30 include a refrigerating compartment door 20 opening and closing the refrigerating compartment 12 and a freezing compartment door 30 opening and closing the freezing compartment 13.

Also, the refrigerating compartment door 20 includes a plurality of doors disposed left and right. The plurality of doors includes a first refrigerating compartment door 21 and a second refrigerating compartment door 22 disposed on a right side of the first refrigerating compartment door 21. The first refrigerating compartment door 21 and the second refrigerating compartment door 22 are configured to independently pivot.

The freezing compartment door 30 includes doors to be slidably withdrawable and vertically disposed. The freezing compartment door 30 may include only one door or more than one door.

In addition, one of the first refrigerating compartment door 21 and the second refrigerating compartment door 22 includes a dispenser 23 for discharging water or ice. In FIG. 1, as an example, the first refrigerating compartment door 21 includes the dispenser 23.

Also, the first refrigerating compartment door 21 includes an ice-making chamber 40 for making and storing ice. The ice-making chamber 40 is configured to have an independent insulating space and to be opened and closed by an ice-making chamber door 41. The ice-making chamber 40 may include an ice maker for making ice therein and may be provided with elements for guiding the made ice to be stored or to be discharged through the dispenser 23.

One side of the ice-making chamber 40 includes a cold air inlet 42 and a cold air outlet 43 that, when the first refrigerating compartment door 21 is closed, connect to a cold air duct 50 included in the cabinet 10. Cold air inserted into the cold air inlet 42 freezes the inside of the ice-making chamber 40 to make ice, and thermal-exchanged cold air is discharged outside the ice-making chamber 40 through the cold air outlet 43.

In some implementations, a heat exchange chamber 14 distinguished from the freezing compartment 13 is located in a rear of the freezing compartment 13. The heat exchange chamber 14 includes a vaporizer, and cold air generated from the vaporizer is supplied to the freezing compartment 13, the refrigerating compartment 12, and the ice-making chamber 40, respectively.

Also, on a side-wall surface of the cabinet 10, the cold air duct 50 for supplying cold air to the ice-making chamber 40 and collecting the cold air of the ice-making chamber 40 is provided. The cold air duct 50 is extended from the freezing compartment 13 toward an upper part of the refrigerating compartment 12 and is connected to the cold air inlet 42 and the cold air outlet 43 when the first refrigerating compartment door 21 is closed. Also, the cold air duct 50 is connected to the heat exchange chamber 14 and the freezing compartment 13.

Accordingly, the cold air of the heat exchange chamber 14 is inserted into the ice-making chamber 40 through a supply channel 51 of the cold air duct 50, and the cold air inside the ice-making chamber 40 is collected to the freezing compartment 13 through a collecting channel 52 of the cold air duct 50. Also, ice may be made and stored inside the ice-making chamber 40 by a continuous circulation of the cold air through the cold air duct 50.

In the case of the refrigerator 1 having the configuration described above, since ice is made and stored inside the ice-making chamber 40 provided on the refrigerating compartment door 20, a volume of the refrigerating compartment door 20 is increased in such a way that a storage space of a rear side of the refrigerating compartment door 20 becomes decreased.

Also, since supply of cold air to the ice-making chamber 40 is needed for making ice, power consumption may be increased.

Figure 3:
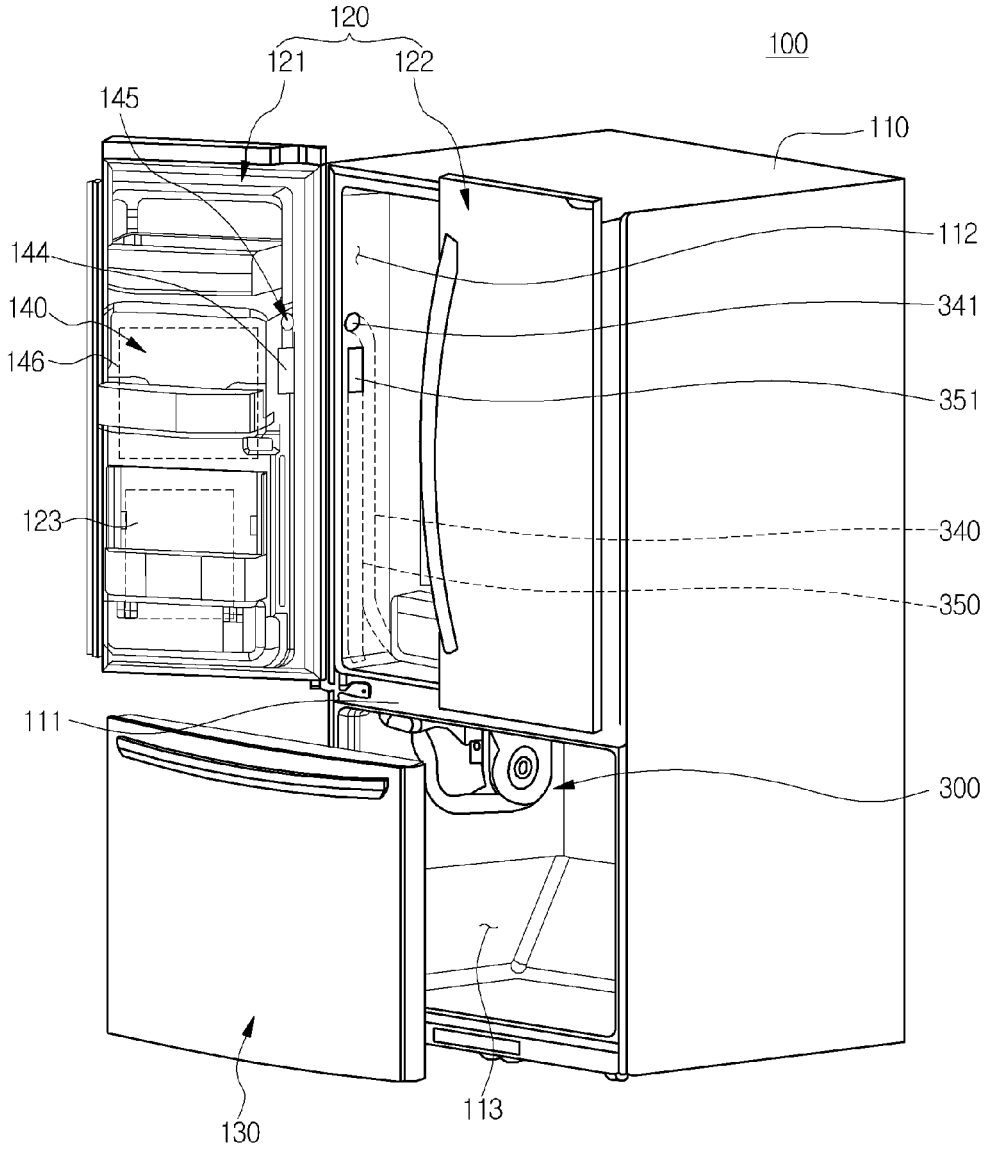
FIG. 3 is a perspective view illustrating an example refrigerator whose doors are opened.
Figure 4:
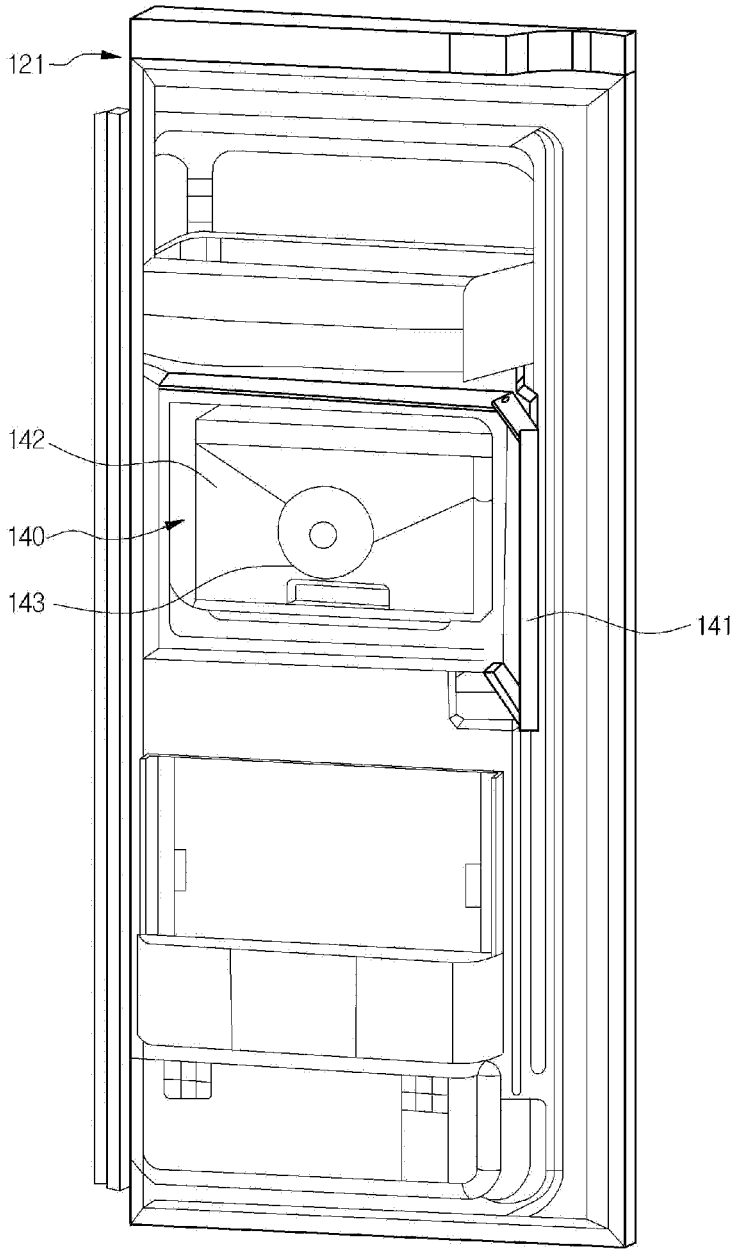
FIG. 4 is a perspective view illustrating an example ice bank whose door is opened.
Figure 5:
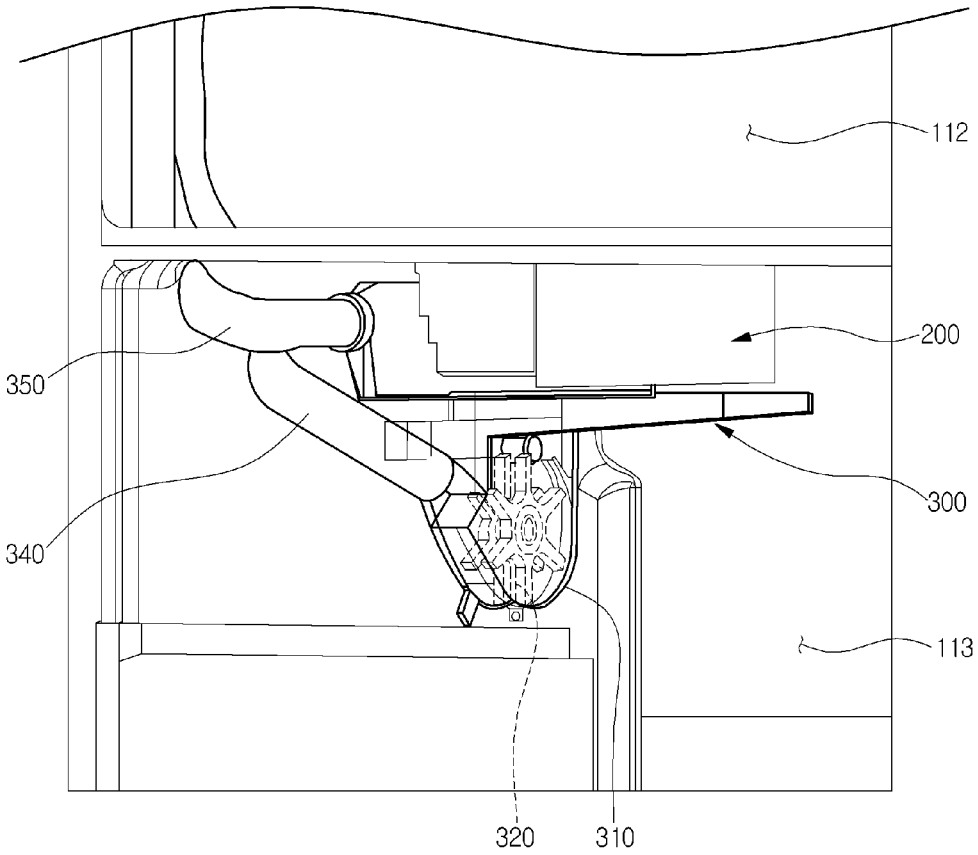
FIG. 5 is a perspective view illustrating the inside of an example freezing compartment.

FIG. 3 illustrates an example refrigerator 100 whose doors are opened, FIG. 4 illustrates an example ice bank 140 whose door 141 is opened, and FIG. 5 illustrates the inside of an example freezing compartment 113.

Referring to FIGS. 3 to 5, an external shape of the refrigerator 100 is defined by a cabinet 110 and doors. Also, the inside of the cabinet 110 is divided by a barrier 111 to define a refrigerating compartment 112 on a top and the freezing compartment 113 on a bottom.

Inside the freezing compartment 113, the freezing compartment 113 includes an ice maker 200 for making ice and an ice transfer device 300 for transferring the made ice to the ice bank 140. Also, the ice transfer device 300 includes a first duct 340 and a second duct 350 that are connected to two holes on a side wall of the refrigerating compartment 112, respectively. In this regard, a first opening 341 on one end of the first duct 340 is connected to one of the two holes on the side wall of the refrigerating compartment 112, and a second opening 351 on one end of the second duct 350 is connected to the other of the two holes. That is, the first opening 341 and the second opening 351 may be disposed on the side wall of the refrigerating compartment 112.

The door includes a refrigerating compartment door 120 shielding the refrigerating compartment 112 and a freezing compartment door 130 shielding the freezing compartment 113. The refrigerating compartment door 120 includes a first refrigerating compartment door 121 and a second refrigerating compartment door 122 provided on left and right sides, which are configured to open and close the refrigerating compartment 112 by pivoting, respectively. Also, the freezing compartment door 130 is configured to be slidably withdrawn and inserted front and rear to open and close the freezing compartment 113.

A dispenser 123 may be provided on a front surface of the first refrigerating compartment door 121. Purified water and ice made by the ice maker 200, which will be described in more detail below, may be discharged outside through the dispenser 123.

In some examples, the ice bank 140 is provided on a rear surface of the refrigerating compartment door 120. The ice bank 140 is a space for storing ice transferred by the ice transfer device 300. The ice bank 140 defines an insulating space and is connected to the first duct 340 and the second duct 350, while the first refrigerating compartment door 121 is closed, to allow supply of ice and circulating cold air. The ice bank 140 is connected to the dispenser 123 to discharge ice stored inside the ice bank 140 while operating the dispenser 123. Also, an additional case 142 containing ice may be provided inside the ice bank 140, an auger 143 to allow the ice to be smoothly transferred, and a blade for grinding or crushing the ice to discharge pieces of the ice may be further provided.

Also, the ice bank 140 is protruded from the rear surface of the refrigerating compartment door 120 and is in contact with an inner wall surface of the refrigerating compartment 112 when the first refrigerating compartment door 121 is closed.

On a side wall surface of the ice bank 140, an air hole 144 and an ice inlet 145 are located. The air hole 144 and the ice inlet 145 have positions corresponding to the second opening 351 and the first opening 341, respectively. That is, when the first refrigerating compartment door 121 is closed, the air hole 144 is connected to the second duct 350 and the ice inlet 145 is connected to the first duct 340. Accordingly, when the first refrigerating compartment door 121 is closed, ice and cold air may be provided from the freezing compartment 113 to the ice bank 140 and the cold air may be collected from the ice bank 140 to the freezing compartment 113.

Inside the freezing compartment 113, a drawer provided to be withdrawable, the ice maker 200, and the ice transfer device 300 may be provided.

The ice maker 200 is for making ice by using water provided from a water source and may be provided on a left top of the freezing compartment 113. The ice maker 200 is fastened and mounted onto a bottom surface of the barrier 111 in such a way that ice made by the ice maker 200 may be dropped downwardly and contained in a housing 310 of the ice transfer device 300.

Also, below the ice maker 200, the ice transfer device 300 for supplying the ice made by the ice maker 200 to the ice bank 140 may be provided. In this case, positions of the ice maker 200 and the ice transfer device 300 may be determined according to a position of the ice bank 140 and may be provided on the left top of the freezing compartment 113, which may be a shortest distance from the ice bank 140 provided on the first refrigerating compartment door 121.

The ice transfer device 300 may be provided below the ice maker 200 and may be fastened to one side wall surface of the freezing compartment 113. A transfer element 320 for transferring ice may be provided inside the housing 310. The housing 310 may be connected to the first duct 340 and the transfer element 320 may transfer made ice to the ice bank 140 via the first duct 340. Also, the cold air of the freezing compartment 113 may be collected or supplied to around the ice transferred along the first duct 340. A detailed configuration of the ice transfer device 300 will be described below.

Also, the second duct 350 is provided on one side of the ice transfer device 300. The second duct 350 is to supply or collect the cold air of the freezing compartment 113 to or from the ice bank 140, an inlet thereof is exposed inside the freezing compartment 113, and an air blowing fan 353 may be provided on one side of the second duct 350 (see, e.g., FIG. 7).

When the air blowing fan 353 rotates forward, the cold air of the freezing compartment 113 is supplied to the ice bank 140 through the second duct 350 and the cold air supplied to the ice bank 140 is collected to the freezing compartment 113 through the first duct 340. When the air blowing fan 353 rotates backwards, the cold air of the freezing compartment 113 is supplied to the ice bank 140 through the first duct 340 and the cold air supplied to the ice bank 140 is collected to the freezing compartment 113 through the second duct 350. In this regard, one of the first duct 340 and the second duct 350 may be understood as a cold air supplying duct for supplying cold air to the ice bank 140 and the other thereof is a cold air collecting duct for collecting the cold air of the ice bank 140 to the freezing compartment 113.

Figure 6:
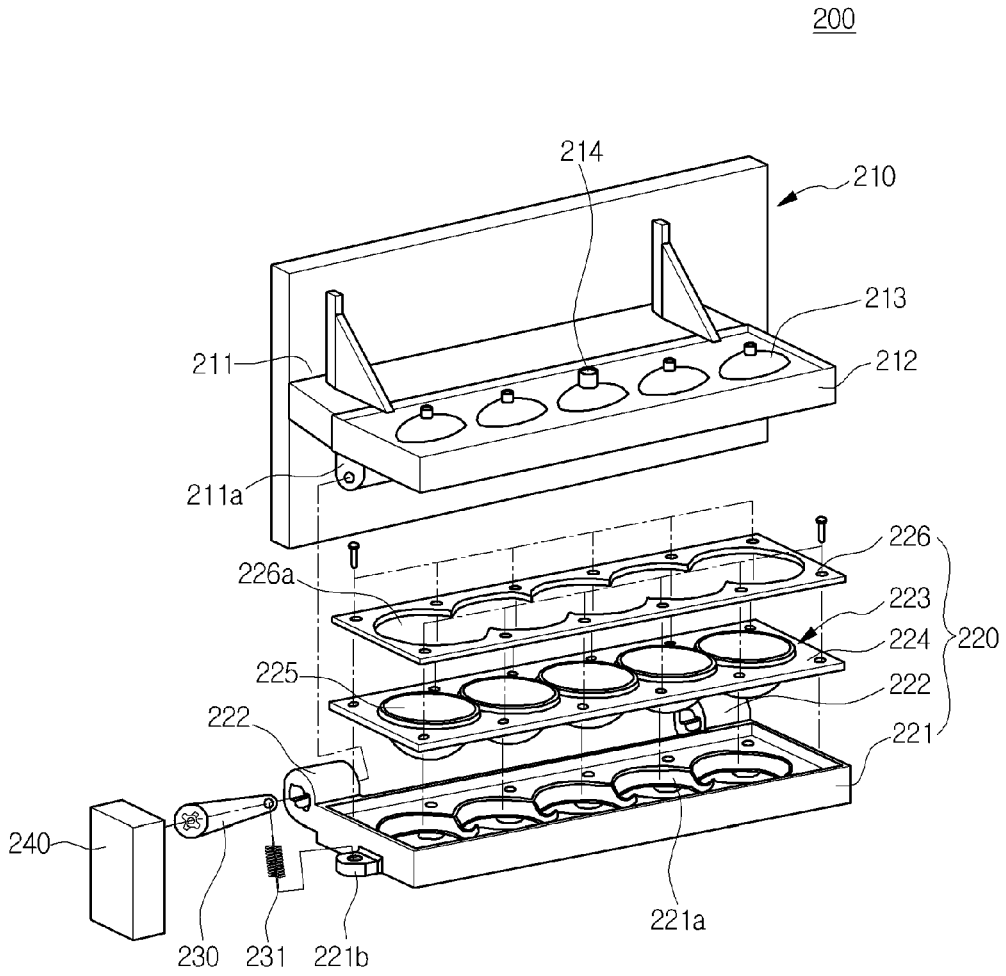
FIG. 6 is an exploded perspective view illustrating an example configuration of an ice maker.

FIG. 6 illustrates an example configuration of the ice maker 200. Referring to FIG. 6, the ice maker 200 is mounted on an ice maker bracket 250 (refer to FIG. 7) provided on the barrier 111. The ice maker 200 may make ice in a certain shape. The ice maker 200 may include an upper tray 210 that defines an upper shape, a lower tray 220 that defines a lower shape, a motor assembly 240 for driving any one of the upper tray 210 and the lower tray 220, and an ejecting unit ejecting ice made by one of the upper tray 210 and the lower tray 220.

In detail, the lower tray 220 has a trapezoidal shape in a top view, and a depression 225 depressed downwards to form a hemisphere inside that shapes a lower part of ice having a spherical shape. The lower tray 220 may be formed of a metallic material, and if necessary, at least a part thereof may be formed of a material elastically deformable. In some examples, part of the lower tray 220 is formed of an elastic material.

The lower tray 220 may include a tray case 221 forming an external shape of the lower tray 220, a tray body 223 mounted on the tray case 221 and forming the depression 225 that is a space for forming the ice, and a tray cover 226 fastening and mounting the tray body 223 to the tray case 221.

The tray case 221 has the shape of a trapezoidal frame and extends along edges upwards and downwards. Also, a seating part 221*a* circularly perforated is located inside the tray case 221. The seating part 221*a* may be formed in the shape corresponding to the depression 225 of the tray body 223, and an inner surface thereof is rounded to allow the depression 225 that is hemispherical to be stably seated. The seating part 221*a* is provided in a plurality thereof disposed consecutively in a line corresponding to a position and the shape of the depression 225 and may be connected to one another.

Also, in a rear of the tray case 221, a lower tray connector 222 is coupled with the upper tray 210 and the motor assembly 240 and allows the tray case 221 to be mounted in a rotatable manner.

Also, one side surface of the tray case 221 includes an elastic element mounting part 221*b* for mounting an elastic element 231 providing elasticity to maintain a closed state of the lower tray 220.

The tray body 223 is formed of a flexible material that is elastically deformable and is seated above the tray case 221. The tray body 223 may include a flat part 224 corresponding to the shape of the tray body 223 and the depression 225 depressed from the flat part 224.

The flat part 224 has the shape of a plate having a certain thickness and may correspond to a shape of a top surface of the tray case 221 to be contained inside the tray case 221. Also, the depression 225 defines a lower part of a cell that is a space where ice is made, has a hemispherical shape, and may have a shape corresponding to a depression 213 of the upper tray 210, which will be described in more detail below. Accordingly, when the upper tray 210 and the lower tray 220 are closed, the upper tray 210 and the lower tray 220 combine to define the cell providing a spherical shape.

The depression 225 may be protruded downwards penetrating the seating part 221*a* of the tray case 221. Accordingly, the depression 225 is configured to be pushed by the ejecting unit while the lower tray 220 is rotating in such a way that ice inside the depression 225 may be ejected outside.

Also, a lower threshold protruded upwards is formed around the depression 225. The lower threshold overlaps an upper threshold of the upper tray 210 when the upper tray 210 and the lower tray 220 are closed, thereby reducing (e.g., preventing) a leakage.

The tray cover 226 is provided above the tray body 223 and is configured to allow the tray body 223 to be fastened to the tray case 221. The tray cover 226 is coupled with a screw or a rivet, which sequentially penetrates the tray cover 226, the tray body 223, and the tray case 221 to assemble the lower tray 220.

Also, a perforation 226*a* corresponding to a shape of an open top of the depression 225 is formed on the tray cover 226. The perforation 226*a* has a shape of consecutively overlapping a plurality of circles. Accordingly, when assembling the lower tray 220 is completed, the depression 225 is exposed through the perforation 226*a* and the lower threshold is located inside the perforation 226*a*.

The upper tray 210 defines an external shape of a top of the ice maker 200 and may include a mounting part 211 for mounting the ice maker 200 and a tray part 212 for forming ice.

In detail, the mounting part 211 is configured to allow the ice maker 200 to be mounted inside the freezing compartment 113 and extends vertically to be perpendicular to the tray part 212. Accordingly, the mounting part 211 may maintain a stable mounting state by a surface contact with the freezing compartment 113.

Also, the tray part 212 may have a shape corresponding to the shape of the lower tray 220, and a plurality of depressions 213 depressed upwards in a hemispherical shape may be formed on the tray part 212. The depressions 213 may be consecutively arranged in a line. Also, when the upper tray 210 and the lower tray 220 are closed, the depressions 225 of the lower tray 220 and the depressions 213 of the upper tray 210 are coupled with one another, thereby forming the cells that are spherical spaces for making ice. The shapes of the upper tray 210 and the depressions 213 may correspond to the shape of the lower tray 220. A water-supply part 214 that is a path for injecting water to the depression 213 may be provided on a top of the depression 213.

In addition, in a rear of the tray part 212, an axis coupling part 211*a* coupled with the lower tray connector 222 on an axis, may be located. The axis-coupling part 211*a* extends downward on both sides of a bottom surface of the tray part 212 and is connected to the lower tray connector 222 by coupling on the axis. Accordingly, the lower tray 220 is coupled with the upper tray 210 on the axis and mounted to be rotatable and may be opened and closed while being rotated by rotation of the motor assembly 240.

The entire upper tray 210 may be formed of a metallic material and may be configured to freeze water inside the cell at high speed by heat conduction. Also, a heater heating the upper tray 210 to eject ice may be further included in the upper tray 210. Also, a water-supply pipe for supplying water to the water-supply part 214 may be disposed above the upper tray 210.

The upper tray 210, as the same as the lower tray 220, may be configured in such a way that the depressions 213 of the upper tray 210 are formed of an elastic material to easily eject ice.

Also, a rotating arm 230 and the elastic element 231 are provided on a side of the lower tray 220. The rotating arm 230 tensions the elastic element 231 and may be mounted on the lower tray 220 to be pivotable.

One end of the rotating arm 230 is coupled with the lower tray connector 222 on an axis and may be configured to further pivot to tension the elastic element 231 although the lower tray 220 is closed. Also, the elastic element 231 is mounted between the rotating arm 230 and the elastic element mounting part 221*b*. The elastic element 231 may be a tensile spring. Accordingly, while the lower tray 220 is being closed, the rotating arm 230 further rotates counterclockwise to allow the elastic element 231 to be tensile. Due to an elastic force of the elastic element 231, the lower tray 220 is closely attached to the upper tray 210, thereby reducing (e.g., preventing) a leakage while making ice.

Further, the motor assembly 240 is provided on the side of the upper tray 210 and the lower tray 220 and may include a motor and may be configured to combine a plurality of gears to control rotation of the lower tray 220.

Figure 7:
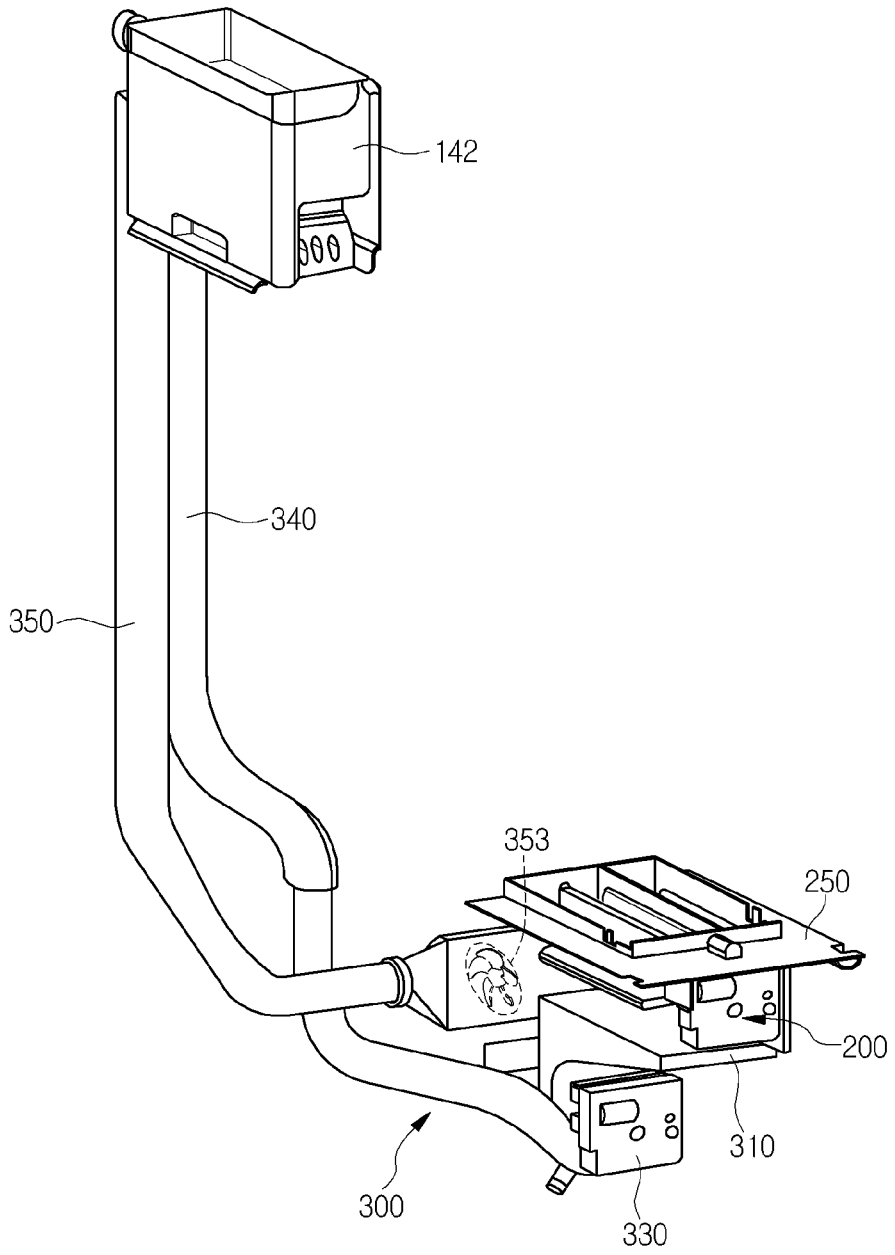
FIG. 7 is an exploded perspective view illustrating an example configuration of an ice transfer device.
Figure 8:
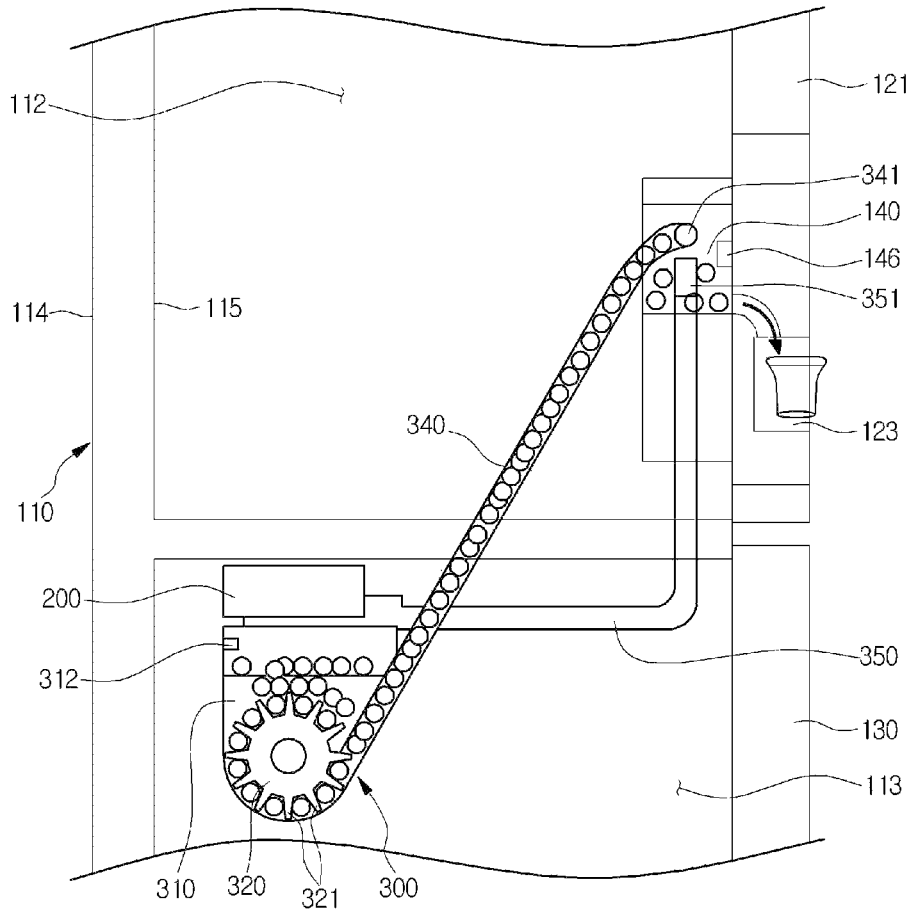
FIG. 8 is a schematic view illustrating a transfer status of ice through the example ice transfer device.

FIG. 7 illustrates an example configuration of the ice transfer device 300. FIG. 8 illustrates example transfer status of ice through the ice transfer device 300.

Referring to FIGS. 7 and 8, the ice transfer device 300 is mounted on an inner case 115 that defines an inner surface of the cabinet 110 and may be exposed inside the refrigerator 100. In this case, the ice transfer device 300 may be mounted on an additional element, such as a bracket coupled with the inner case 115. Also, in the case of the ice transfer device 300, for insulation, at least a part of the ice transfer device 300 may be configured to be buried in an insulation provided between an outer case 114 and the inner case 115.

The ice transfer device 300 may include the housing 310 to which pieces of ice ejected from the ice maker 200 are supplied, the transfer element 320 provided inside the housing and transferring the ice inside the housing 310, a driving unit 330 for driving the transfer element 320 to rotate, and the first duct 340 for guiding the ice inside the housing 310 to the dispenser 123.

The housing 310 is provided below the ice maker 200. Also, the housing 310 has a space for containing ice and the transfer element 320 therein, and a top of the housing 310 is opened to allow the ice supplied from the ice maker 200 to be contained.

In this case, the top of the housing 310 is located below the ice maker 200 and may be exposed inside the freezing compartment 113. Also, a bottom of the housing, in which the transfer element 320 is contained, may be buried in the insulation between the outer case 114 and the inner case 115.

Also, the transfer element 320 is provided inside the housing 310. The transfer element 320 may have the shape of a gear or a vane and is shaped to contain pieces of ice made to be in a spherical shape between a plurality of protrusions 321 formed on the transfer element 320.

The entire transfer element 320 is contained in the housing, and a rotation axis of the transfer element 320 penetrates the housing 310 and is exposed outside the housing 310. Also, the driving unit 330 is connected to the rotation axis of the transfer element 320 to provide power to allow the transfer element 320 to rotate.

The driving unit 330 is configured to provide the power to allow the transfer element 320 to rotate. The driving unit 330 may include a driving motor providing a rotating force and a gear assembly rotated by the driving motor. The gear assembly may be provided in a plurality thereof and may be configured to control a rotation speed of the transfer element 320 by using a combination of a plurality of gears.

The first duct 340 guides the ice made by the ice maker 200 to the ice bank 140 and guides cold air circulating the freezing compartment 113 and the ice bank 140 at the same time. The first duct 340 extends from one side of the housing 310 to the first refrigerating compartment door 121 on which the ice bank 140 is mounted and may have the shape of a hollow pipe to transfer spherical pieces of ice. When the first duct 340 is provided in a cylindrical shape, an inner diameter of the first duct 340 corresponds to a diameter of the spherical pieces of ice or greater in such a way that the ice may be consecutively transferred in a line. The first duct 340 is not limited to the cylindrical shape and may have various shapes. Additional shapes are described below in detail with reference to FIGS. 9 to 11.

The first duct 340 may penetrate the barrier 111 and may be mounted to be exposed outside the freezing compartment 113 and the refrigerating compartment 112. In this case, an insulation element is further provided outside the first duct 340 in such a way that heat exchange between the refrigerating compartment 112 and the first duct 340 is not performed.

In addition, the first duct 340 may be disposed between the outer case 114 and the inner case 115. That is, the first duct 340 may be located inside the side wall of the cabinet 110, corresponding to the first refrigerating compartment door 121. In this case, the first duct 340 may be insulated by an insulation element inside the cabinet 110 and is not exposed inside the refrigerator 100.

The first duct 340 may extend to an inner wall surface of the refrigerating compartment 112, corresponding to the position of the ice bank 140. Also, on a top end of the first duct 340, the first opening 341 opened at the inner wall surface of the refrigerating compartment 112 is formed.

Accordingly, when the first refrigerating compartment door 121 is closed, the ice bank 140 and the first duct 340 may be connected to each other. Accordingly, ice may be transferred along the first duct 340 and supplied to the ice bank 140 by rotation of the transfer element 320.

Further, the second duct 350, together with the first duct 340, is configured to allow the cold air of the freezing compartment 113 to circulate the ice bank. The second duct 350 is arranged along the refrigerating compartment 112 on one side of the freezing compartment 113 and may be buried inside the cabinet 110 together with the first duct 340. The second duct 350 is connected to the ice bank 140 and supplies or collects cold air when the first refrigerating compartment door 121 is closed.

While the refrigerator 100 is operating, cold air generated by a vaporizer may be supplied to the ice maker 200 provided inside the freezing compartment 113. Water supplied to the inside of the ice maker 200 forms spherical pieces of ice inside the ice maker 200. When making ice is completed, the ice drops downwards by the heater or another element for ejecting ice included in the ice maker 200.

Below the ice maker 200, the inlet of the housing 310 is opened upwards in such a way that the spherical pieces of ice may be supplied to the housing 310. The ice supplied to the top of the housing 310 may be transferred according to the rotation of the transfer element 320.

In detail, the plurality of protrusions 321 on the transfer element 320 define spaces for containing one spherical piece of ice between each set of adjacent protrusions 321. Accordingly, the ice inserted inside the housing 310 is contained in the space between the plurality of protrusions 321 of the transfer element 320 by the rotation of the transfer element 320.

The ice contained in the space formed on the transfer element 320 may be transferred according to the rotation of the transfer element 320. A state in which the first duct 340 is filled with ice is maintained and the ice inside the first duct 340 may be pushed according to the rotation of the transfer element 320 and may be discharged to the ice bank 140.

The ice discharged to the ice bank 140 is stored inside the ice bank 140, and the ice stored inside the ice bank 140 may be discharged through the dispenser 123 when operating the dispenser 123.

Also, the ice bank 140 may include a sensor 146 for sensing whether the ice bank 140 is fully filled with ice or not. Also, a sensor 312 may be further included inside the housing 310. The ice bank 140 and the housing 310 are allowed to maintain a state of being filled with ice more than a preset amount by the sensors 146 and 312 and the ice maker 200 is controlled to operate until the ice bank 140 is filled with the ice more than the preset amount, by the sensors 312 and 146. In the state as described above, ice may be supplied to the ice bank 140 by the operations of the transfer element 320.

When a user operates the dispenser 123 while the ice bank 140 is being filled with the ice, operations of the driving unit 330 starts. When the transfer element 320 rotates, the ice contained in the space formed on the transfer element 320 also rotates in such a way that ice contained in the bottom of the first duct 340 is pushed upwards. When the ice in the bottom of the first duct 340 is pushed upwards, ice sequentially deposited inside the first duct 340 is also pushed upwards at the same time. Also, the spherical pieces of ice may be supplied to the ice bank 140 through the opening 341 of the first duct 340 and may be discharged outside through the dispenser 123.

In this case, the ice discharged outside the dispenser 123 includes spherical pieces in such a way that a desired number of pieces of ice may be discharged according to the operation of the user.

The operation of the driving unit 330 may be restricted by a door sensor sensing whether the refrigerating compartment door 120 is open or not. That is, when the user operates the dispenser 123 while the refrigerating compartment door 120 is opened, the driving unit 330 is stopped in such a way that discharging the ice is not performed.

In addition, the cold air of the freezing compartment 113 circulates inside the ice bank 140. For instance, a circulation flow channel includes the freezing compartment 113, the second duct 350, the ice bank 140, the first duct 340, and the freezing compartment 113. The cold air of the freezing compartment 113 circulates the circulation flow channel in order or in reverse order according to a direction of rotation of the air blowing fan 353. The circulating cold air is supplied to the inside of the ice bank 140 and prevents the ice from melting.

Figure 9A:
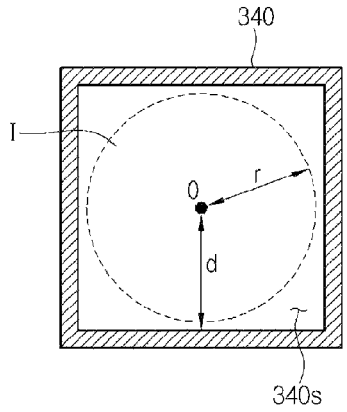
FIG. 9A is a horizontal cross-sectional view illustrating an example first duct.
Figure 9B:
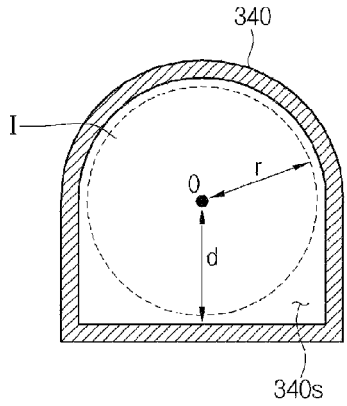
FIG. 9B is a horizontal cross-sectional view illustrating another example first duct.
Figure 9C:
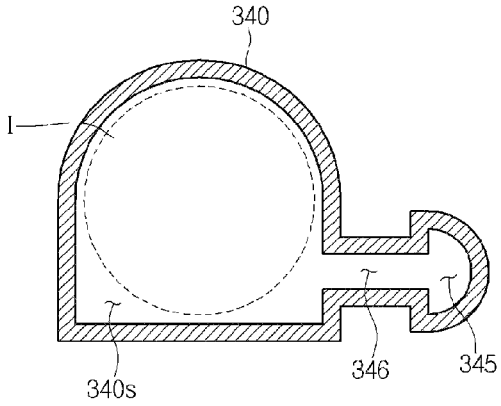
FIG. 9C is a horizontal cross-sectional view illustrating yet another example first duct.

FIG. 9A is a horizontal cross-sectional view illustrating the first duct 340 according to a first example, FIG. 9B is a horizontal cross-sectional view illustrating the first duct 340 according to a second example, and FIG. 9C is a horizontal cross-sectional view illustrating the first duct 340 according to a third example.

Referring to FIG. 9A, a cross section of the first duct 340 may have a different shape than a cross section of the ice made by the ice maker 200. The cross section of the first duct 340 may be a polygonal shape. As an example, the cross section of the first duct 340 may be a tetragonal shape. A distance d from a central portion O of the first duct 340 and an inner wall of the first duct 340 may correspond to a radius r of ice I guided inside the first duct 340 (or be slightly greater) to guide the ice I in a line.

A cold air circulating space 340*s* is formed between the ice I and the inner wall of the first duct 340. Particularly, when the cross section is tetragonal, the cold air circulating space 340*s* is formed in four corner areas of the first duct 340. The cold air circulating the ice bank 140 may circulate through the cold air circulating space 340*s*. According to the spherical shape of the ice I, since the ice I is not located in the cold air circulating space 340*s*, the ice and the cold air may circulate through the first duct 340 at the same time.

Referring to FIG. 9B, at least a part of the cross section of the first duct 340 may be rounded with a certain curvature. As an example, the cross section of the first duct 340 may have a hemispherical shape. When having a shape shown in FIG. 9B, the cold air circulating space 340*s* may be formed in two places. Through the cold air circulating space 340*s*, the circulating cold air may circulate with no interference of the ice I.

Referring to FIG. 9C, an auxiliary duct 345, through which only cold air may flow, may be formed on a side of the first duct 340. Since the auxiliary duct 345, if necessary, may increase a cross-sectional area thereof, cold air may smoothly circulate or an amount of circulating cold air may be increased by reducing resistance inside the first duct.

Also, between the first duct 340 and the auxiliary duct 345, a connecting duct 346 connecting the first duct 340 and the auxiliary duct 345 to each other may be formed. The cold air flowing through the auxiliary duct 345 may spread to the first duct 340 through the connecting duct 346.

Figure 10A:
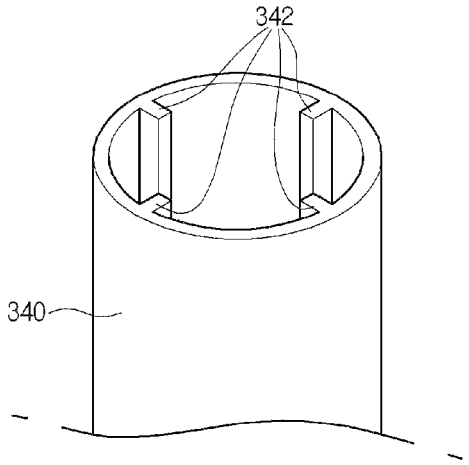
FIG. 10A is a perspective view illustrating a further example first duct.
Figure 10B:
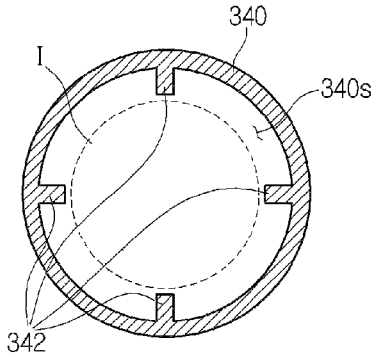
FIG. 10B is a horizontal cross-sectional view illustrating the example first duct shown in FIG. 10A.
Figure 10C:
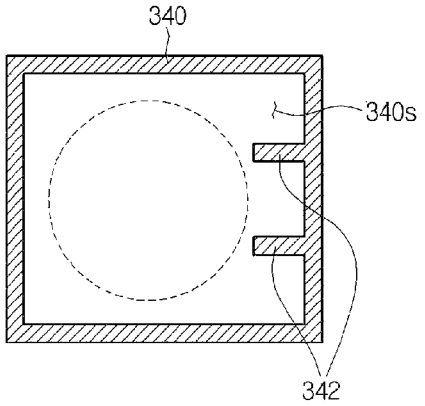
FIG. 10C is a horizontal cross-sectional view illustrating an additional example first duct.

FIG. 10A is a perspective view illustrating the first duct 340 according to a fourth example, FIG. 10B is a horizontal cross-sectional view illustrating the first duct 340 according to the fourth example, and FIG. 10C is a horizontal cross-sectional view illustrating the first duct 340 according to a fifth example.

Referring to FIGS. 10A and 10B, a rib 342 protruded toward the inside of the first duct 340 is formed on the inner wall of the first duct 340. The rib 342 extends along the first duct 340 and may be formed in a plurality thereof. The rib 342 guides the ice I transferred into the inside of the first duct 340.

The rib 342 may have a radial shape. In this case, since the ice I is transferred in the center of the first duct 340, the ice I and the inner wall of the first duct 340 maintain a state of being separated from each other. A space between the ice I and the inner wall of the first duct 340 may be the cold air circulating space 340*s*. Through the cold air circulating space 340*s*, the circulating cold air may smoothly circulate with no interference of the ice I.

Referring to FIG. 10C, the rib 342 may be formed on a right side of the inner wall of the first duct 340. The ice I may be guided by the rib 342 and may be transferred in a left side of the first duct 340. Accordingly, the ice I maintains a state of being separated from the right side of the first duct 340. A space between the ice I and the inner wall of the first duct 340 may be the cold air circulating space 340*s*.

Figure 11A:
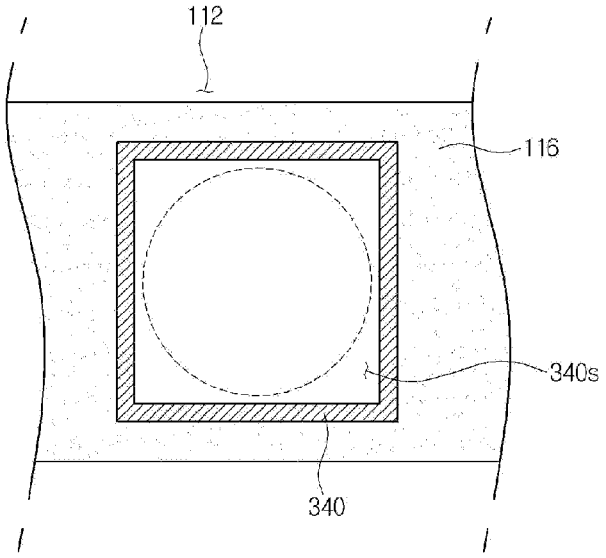
FIG. 11A is a horizontal cross-sectional view illustrating a state of the example first duct of FIG. 9A buried in an insulation element.
Figure 11B:
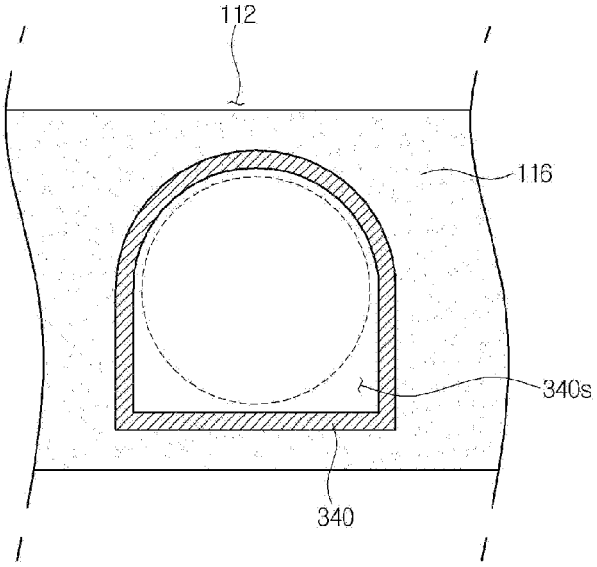
FIG. 11B is a horizontal cross-sectional view illustrating a state of the example first duct of FIG. 9B buried in the insulation element.

FIG. 11A is a horizontal cross-sectional view illustrating a state in which a part of the first duct 340 shown in FIG. 9A is buried in an insulation element, and FIG. 11B is a horizontal cross-sectional view illustrating a state in which a part of the first duct 340 shown in FIG. 9B is buried in the insulation element.

In FIGS. 11A and 11B, two types of the first duct 340 are shown. The first ducts 340 may have different shapes, such as a tetragon and a hemisphere, but have the same widths and heights, respectively.

In the first duct 340 shown in FIG. 9A, four cold air circulating spaces 340*s* are provided. In the first duct 340 shown in FIG. 9B, two cold air circulating spaces 340*s* are provided. Accordingly, circulation of the cold air may be performed more smoothly in the first duct 340 shown in FIG. 9A than that in the first duct 340 shown in FIG. 9B.

On the other hand, as the cross section of the first duct 340 becomes narrower, an insulating space 116 surrounding the first duct 340 may increase. That is, since having a greater insulating space 116, the first duct 340 shown in FIG. 9B is more insulated than the first duct 340 shown in FIG. 9A. Accordingly, the first duct 340 shown in FIG. 9B may be improved in external dew formation and power consumption.

A designer, according to requirements, may use first ducts having various shapes as described above.

Since the ice maker 200 is located in the freezing compartment 113, a space for providing an additional ice maker 200 on the refrigerating compartment door 120 may be omitted in such a way that convenience of discharging ice may be maintained, and simultaneously, a space for storage on a rear surface of the refrigerating compartment door 120 may be increased. Accordingly, convenience of use may be maintained, and storage capacity of the entire refrigerator may be increased.

Also, since ice-making is performed in the refreezing compartment 113, efficiency of making ice may be improved.

Since the first duct 340 allows transferring ice and circulating cold air to be performed at the same time, the number of ducts included in a refrigerator may be reduced and a system may be simplified, thereby minimizing a loss in insulation, reducing a heat transfer area to be discharged outside, and increasing efficiency of power consumption.

In addition, according to an inner shape of a duct, cold air may smoothly circulate while being not interfered by ice guided by the duct.

Although implementations have been described with reference to a number of illustrative examples thereof, it should be understood that numerous other modifications and examples can be devised by those skilled in the art that will fall within the spirit and scope of the principles of this disclosure. More particularly, various variations and modifications are possible in the component parts and/or arrangements and fall within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet;

a refrigerating compartment located in the cabinet;

a freezing compartment located in the cabinet;

a refrigerating compartment door configured to open and close at least a portion of the refrigerating compartment;

an ice bank installed on the refrigerating compartment door and configured to store ice therein;

a dispenser provided below the ice bank and configured to discharge ice stored in the ice bank through the refrigerating compartment door;

an ice maker provided in the freezing compartment and configured to make ice;

a transfer device connected to a side of the ice maker and configured to transfer ice made by the ice maker to the ice bank;

a first duct connecting an outlet of the transfer device to the ice bank and defining a path for transferring ice from the transfer device to the ice bank; and a second duct configured to enable exchange of air between the ice bank and the freezing compartment, wherein one of the first duct and the second duct is a cold air supply duct configured to supply cold air from the freezing compartment to the ice bank and the other of the first duct and the second duct is a cold air return duct configured to return cold air of the ice bank to the freezing compartment, wherein the transfer device includes:

a housing to which pieces of ice ejected from the ice maker are supplied;

a transfer element rotatably provided inside the housing to transfer the ice inside the housing to the first duct; and a driving motor connected to a rotation axis of the transfer element, wherein the transfer element includes a plurality of protrusions radially extending from the rotation axis and configured to receive pieces of ice in spaces which are defined between adjacent protrusions, wherein the first duct includes:

a plurality of ribs that each radially protrude from an inner wall of the first duct toward a center of the first duct such that ends of the ribs are spaced apart from the inner wall of the first duct, the pieces of ice being guided to the ice bank in the center of the first duct by contacting the ends of the ribs such that the pieces of ice are spaced apart from the inner wall of the first duct; and a plurality of cold air flowing spaces that are each defined by the inner wall of the first duct, adjacent ribs, and the pieces of ice, wherein the plurality of cold air flowing spaces are configured to enable the cold air to flow from the freezing compartment to the ice bank.

2. The refrigerator of claim 1, wherein the first duct is configured to guide cold air between the ice being transferred and an inner wall of the first duct.

3. The refrigerator of claim 1, further comprising a fan provided on a side of the first duct and configured to promote cold air circulation between the ice bank and the freezing compartment.

4. The refrigerator of claim 3, wherein the fan is configured to supply cold air from the freezing compartment to the ice bank or return cold air from the ice bank to the freezing compartment according to a direction of rotation thereof.

5. The refrigerator of claim 1, wherein the ice maker is configured to make spherical pieces of ice.

6. The refrigerator of claim 5, wherein the ice maker comprises:

an upper tray comprising a first depression; and a lower tray comprising a second depression, the upper tray and the lower tray being arranged such that the first depression extends away from the lower tray and the second depression extends away from the upper tray.

7. The refrigerator of claim 6, wherein the first depression and the second depression each have a hemisphere shape.

8. The refrigerator of claim 1, further comprising:

a sensor mounted to the ice bank and configured to detect a level of ice in the ice bank.

9. The refrigerator of claim 1, wherein the one or more spaces defined between the adjacent protrusions of the transfer element are each configured to receive a single piece of ice.

10. The refrigerator of claim 1, wherein the first duct is located on an inside side wall of the cabinet and is configured to be disposed between an outer case and an inner case.

11. The refrigerator of claim 1, wherein the driving unit comprises a gear assembly, and wherein the gear assembly is configured to control a speed of rotation of the transfer element.

* * * * *